US006900380B2

(12) United States Patent
Shigenaga

(10) Patent No.: US 6,900,380 B2
(45) Date of Patent: May 31, 2005

(54) FOOT PEDAL FOR DRUM

(75) Inventor: Fumihiro Shigenaga, Hamakita (JP)

(73) Assignee: Yamaha Corporation (JP)

( * ) Notice: Subject to any disclaimer, the term of this patent is extended or adjusted under 35 U.S.C. 154(b) by 89 days.

(21) Appl. No.: 10/371,906

(22) Filed: Feb. 20, 2003

(65) Prior Publication Data

US 2003/0167545 A1 Sep. 4, 2003

(30) Foreign Application Priority Data

Feb. 22, 2002 (JP) ..... P2002-045897

(51) Int. Cl.[7] ..... G10D 13/02
(52) U.S. Cl. ..... 84/422.2
(58) Field of Search ..... 84/422.1, 422.3, 84/422.2, 421; 403/100, 83

(56) References Cited

U.S. PATENT DOCUMENTS 5,659,144 A * 8/1997 Shigenaga ..... 84/422.1
5,895,168 A 4/1999 Liao
6,028,259 A * 2/2000 Lombardi et al. ..... 84/422.1

FOREIGN PATENT DOCUMENTS

JP Sho 55-45433 10/1980
JP Sho 58-43035 9/1983
JP 8-248947 9/1996
JP 08-314447 11/1996

OTHER PUBLICATIONS

Japanese Office Action issued Oct. 5, 2004 (Translation of relevant portions).

* cited by examiner

*Primary Examiner*—Kimberly Lockett
(74) *Attorney, Agent, or Firm*—Dickstein, Shapiro, Morin & Oshinsky, LLP.

(57) ABSTRACT

A foot pedal for a drum is basically constituted by a foot board, a depression transmission member, a pedal frame having a pair of support members, a rotation shaft, a rocker, a beater rod, and a beater. Herein, the rocker comprises a rocker body and a rod fixing portion having a fixing member receiving portion for receiving a fixing member. In assembly, the fixing member is attached to the beater rod and is then received by the fixing member receiving portion; thereafter, a bolt is deeply screwed into the rocker to press the beater rod to the interior wall of the rod insertion hole, so that the fixing member is correspondingly moved backwards and is completely engaged with the fixing member receiving portion. Thus, it is possible to reliably avoid unwanted axial rotation of the beater rod during the play of a bass drum with the foot pedal.

10 Claims, 4 Drawing Sheets

FOOT PEDAL FOR DRUM

BACKGROUND OF THE INVENTION

1. Field of the Invention

This invention relates to foot pedals for drums, in particular, bass drums, which are beaten by beaters interlocked with foot boards when depressed.

2. Description of the Related Art

Foot pedals are normally used for playing bass drums and are operated by users (or operators) who depress foot boards (or pedals) with their feet, thus rotatably moving beaters (or mallets) to beat drumheads of bass drums. Specifically, a beater rod is attached to a rotation shaft of the foot board via a rocker, so that when the foot board is depressed by an operator's foot, a beater attached to the tip end of the beater rod is rotatably moved to beat the bass drum. Herein, the beater rod is inserted into a rod insertion hole of the rocker, so that the beater rod is pressed and fixed to the wall of the rod insertion hole using a fixing bolt, for example. Various types of foot pedals have been disclosed in Japanese Examined Utility-Model Publication No. Sho 55-45433, Japanese Examined Utility-Model Publication No. Sho 58-43035, and Japanese Unexamined Patent Publication No. Hei 8-314447, for example.

If the beater rod is not properly fixed to the rocker, the beater must be shifted in position so that a beating portion of the beater for actually beating the drumhead of a bass drum is correspondingly changed, or the contact area between the beater and drumhead must be varied to cause unwanted variations of sounds when playing the bass drum. Therefore, it is required to properly fix the beater rod to the rocker in such a way that the direction of the beater (in other words, the beating portion of the beater) is normally fixed in a prescribed positional relationship with the drumhead of the bass drum. Conventionally, the user (or operator) fixes the beater rod to the rocker and manually adjusts them with visual confirmation as to whether the beating portion of the beater is properly brought into contact with the drumhead upon depression of the foot board. That is, the operator is required to perform such troublesome and complicated manual operations in fixing and adjusting the beater rod to the rocker while visually confirming positional relationship therebetween before playing the bass drum with the foot pedal. This may easily cause occurrence of error in fixing the beater rod to the rocker when the operator makes visual confirmation in a slanted direction.

The aforementioned problem may be solved by adapting a specific structural design realizing avoidance of axial rotation of the beater rod. That is, as shown in FIG. 4, a fixing member B shaped like a hexahedron is screwed to the base portion of a beater rod A, and it is brought into contact with a prescribed (step) difference D of a rocker C, thus avoiding unwanted axial rotation of the beater rod A.

In the aforementioned structural design, the fixing member B is merely brought into contact with the difference D of the rocker C. In other words, it lacks a function for firmly fixing the fixing member B to the rocker C. Therefore, there still remains a possibility that a beater E may be easily changed in the direction thereof when the beater rod A is unexpectedly rotated while the user plays the bass drum with the foot pedal.

Due to the provision of the difference D, it is possible to reduce axial rotation of the beater rod A, so that the operator can easily fix the beater rod A to the rocker C when assembling the foot pedal. However, when the operator tightly screws them together, the beater rod A should be pressed and brought into linear or area contact with the interior wall of the rod insertion hole of the rocker C in its entire length, so that the fixing member B is correspondingly moved in a direction to leave from the difference D of the rocker C. This causes an unwanted gap to be formed between the fixing member B and the difference D of the rocker C. For this reason, it is difficult to normally secure a prescribed gap (or a prescribed positional relationship) between the fixing member B and the difference D of the rocker C. In other words, it is difficult to normally fix a prescribed direction for the beater E relatively to the drumhead; that is, it is very difficult to accurately establish prescribed positioning with respect to the direction of the beater E.

In addition, the beater rod A is fixed in the rod insertion hole of the rocker C by using a screw, wherein due to insufficient fixation for holding the beater rod A together with the rocker C, the beater rod A may be changed in the direction thereof during the play of a bass drum, or the beater rod A may be unexpectedly extracted from the rod insertion hole of the rocker C.

SUMMARY OF THE INVENTION

It is an object of the invention to provide a foot pedal for a drum (e.g., a bass drum) in which a fixing member is attached to a beater rod and is firmly fixed to a rocker so as to avoid unwanted axial rotation of the beater rod, thus reliably securing a desired direction of a beater relative to a drumhead.

A foot pedal for a drum is basically constituted by a foot board, a depression transmission member, a pedal frame on which a pair of support members are planted with a prescribed space therebetween, a rotation shaft bridged between upper ends of the support members, a rocker attached to a prescribed position of the rotation shaft, a beater rod firmly equipped with the rocker, and a beater attached to the tip end of the beater.

This invention is characterized in that the rocker is constituted by a rocker body and a rod fixing portion having a fixing member receiving portion for receiving a fixing member. Specifically, the rocker body has a disk-like shape, and the rod fixing portion is integrally projected from the outer circumference of the rocker body, wherein the fixing member receiving portion is integrally projected from the upper surface of the rod fixing portion, and it has a trapezoidal concavity having tapered slopes. The fixing member has an engagement portion having tapered slopes to substantially match the trapezoidal concavity of the fixing member receiving portion when engaged together.

In assembly, the fixing member is attached to the beater rod in such a way that the beater rod is inserted into a through hole of the fixing member and is fixed in position by use of a bolt; then, the fixing member attached to the beater rod is engaged with the fixing member receiving portion in such a way that the lower portion of the beater rod is inserted into a rod insertion hole of the rod fixing portion of the rocker and is fixed in position by use of a bolt. After the fixing member is received by the fixing member receiving portion of the rocker, the bolt is deeply screwed to press the beater rod to the interior wall of the rod insertion hole, so that the fixing member is correspondingly moved backwards and is completely engaged with the fixing member receiving portion. Therefore, the beater rod is sequentially inserted through the fixing member and the rod fixing portion of the rocker, and it is firmly fixed in position. Thus, it is possible to reliably avoid unwanted axial rotation of the beater rod during the play of a bass drum with the foot pedal. That is, it is possible to fix the beater of the beater rod normally with a prescribed directivity relative to the drumhead of a bass drum.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
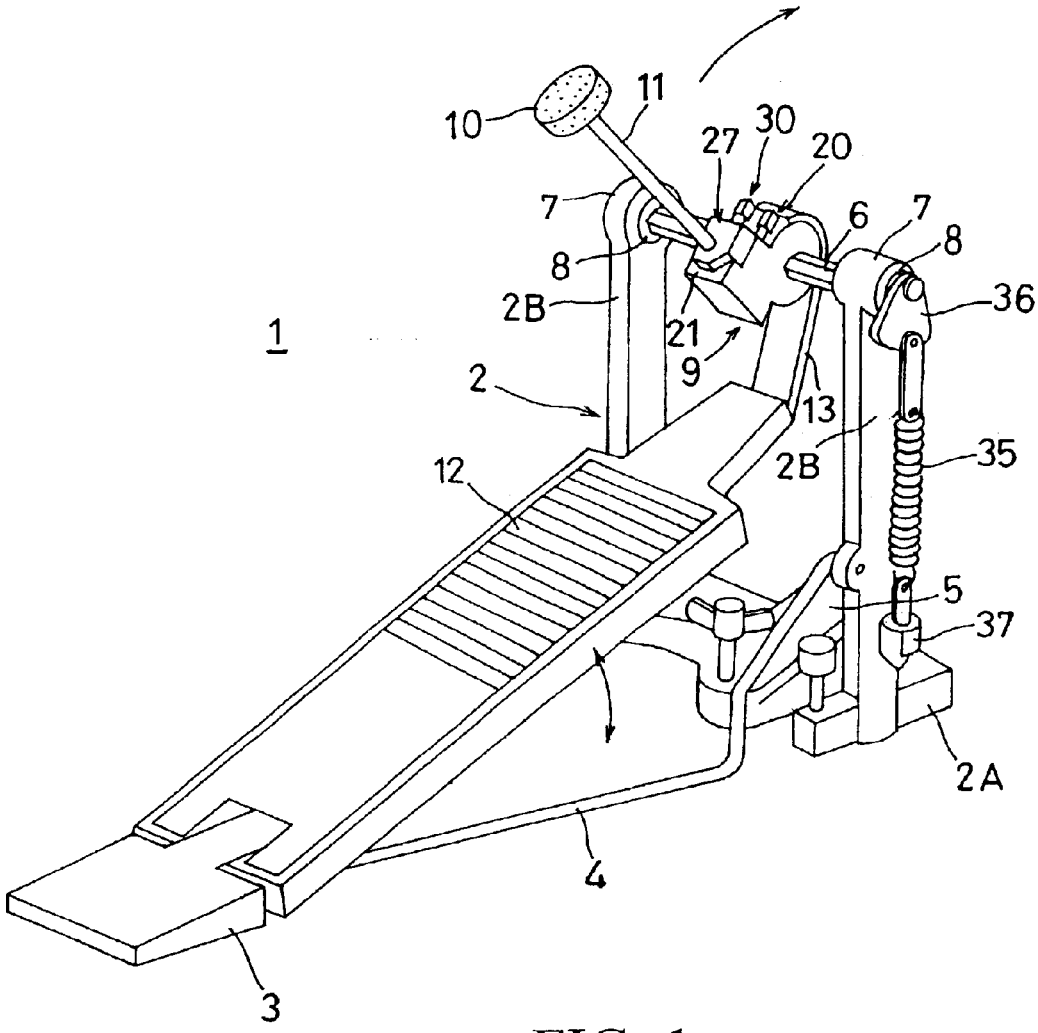
FIG. 1 is a perspective view showing the appearance of a foot pedal for a drum in accordance with a preferred embodiment of the invention.
Figure 2:
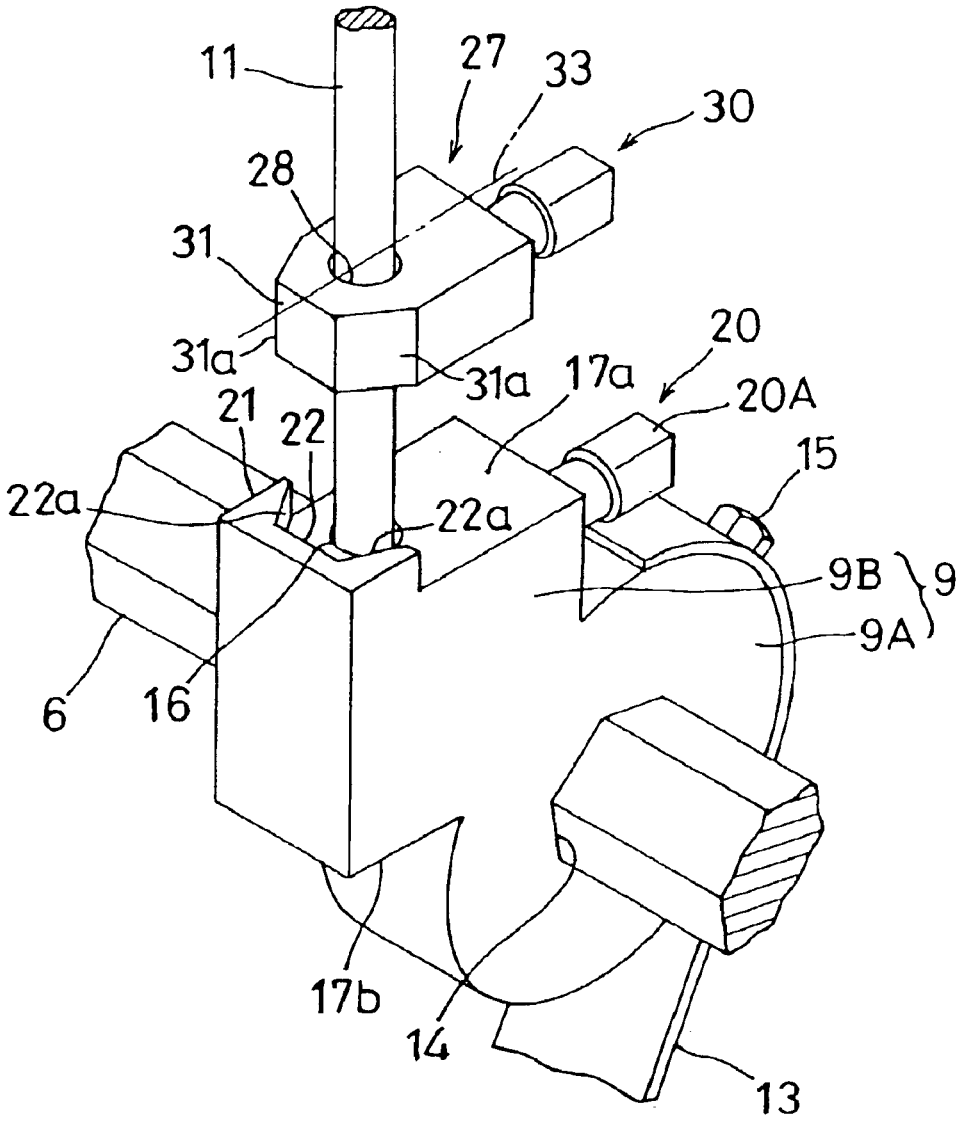
FIG. 2 is a perspective view showing a structure for fixing a beater rod to a rocker in the foot pedal.
Figure 3:
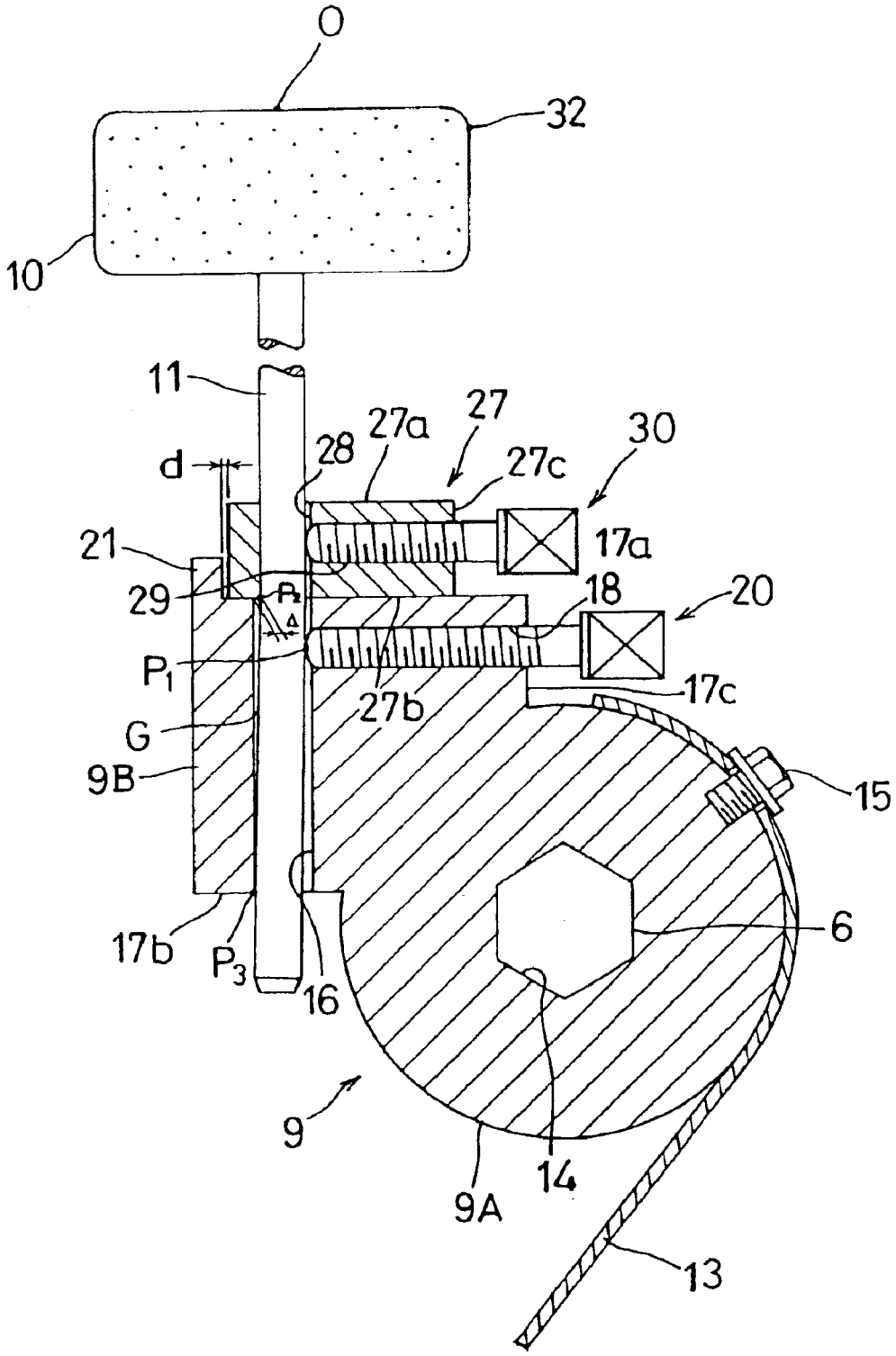
FIG. 3 is a cross sectional view showing the structure for fixing the beater rod to the rocker in the foot pedal.
Figure 4:
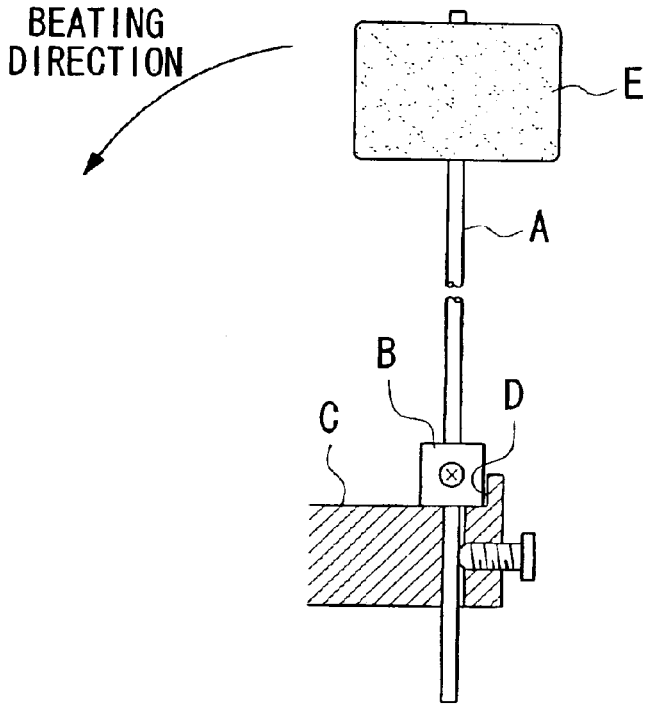
FIG. 4 is an enlarged view partly in cross section showing an example of a structure of prescribed parts in a foot pedal.

FIG. 1 is a perspective view showing an appearance of a foot pedal for a drum (e.g., a bass drum, not shown) in accordance with the preferred embodiment of the invention. FIG. 2 is a perspective view showing a structure for fixing a beater rod to a rocker in the foot pedal; and FIG. 3 is a cross sectional view showing a structure for fixing the beater rod to the rocker. As shown in FIG. 1, a foot pedal 1 is equipped with a pedal frame 2 that is arranged on the floor surface (not shown) and that is manufactured in die casting using aluminum alloy and the like. The pedal frame 2 is basically constituted in such a way that a pair of support members (both designated by the same reference numeral "2B") are planted on both ends of a frame body 2A having a plate-like shape, which is interconnected with a heel 3 via an interconnecting member 4. A clamp (metal) member 5 is attached onto the upper surface of the frame body 2A in order to tightly hold a clamp frame (or a hoop) for clamping a bass drum (not shown).

A rotation shaft 6 is bridged between the upper ends of the support members 2B that are extended upwards from the frame body 2A, between which it can be freely rotated. That is, the upper ends of the support members 2B construct bearings 7, which are equipped with bearing supports 8 for supporting both ends of the rotation shaft 6. A rocker 6 is fixed to the center portion of the rotation shaft 6 and is equipped with a beater 10 for beating the drumhead of the bass drum (not shown) via a beater rod 11. A foot board 12 is arranged in such a way that the back end thereof is attached to the heel 3 while the front end thereof is interconnected with the rocker 9 via a depression transmission member 13.

As shown in FIGS. 2 and 3, the rocker 9 is constituted by a rocker body 9A having a disk-like shape and a rod fixing portion B having a rectangular-block-like shape, which is integrally formed together with the rocker 9A and is projected from the outer circumference of the rocker body 9A. An engagement hole 14 having an equilateral hexagonal shape is formed to penetrate through the center portion of the rocker body 9A, and the upper end of the depression transmission member 13 is firmly fixed to a prescribed side portion of the outer circumference of the rocker 9A by use of a bolt 15. In order to engage with the hexagonal engagement hole 14 of the rocker 9A, the center portion of the rotation shaft 6 is formed with a hexagonal cross sectional shape.

A rod insertion hole 16 is formed to penetrate through the rod fixing portion 9B in the thickness direction between upper and lower surfaces 17*a* and 17*b*, so that the base portion of the beater rod 11 is inserted into the rod insertion hole 16 of the rod fixing portion 9B. In addition, a tapped hole 18 into which a bolt 20 is inserted to fix the rocker 9 and the beater rod 11 together is formed to penetrate through the rod fixing portion 9B from its side surface 17C and is communicated with the rod insertion hole 16. The bolt 20 has a head 20A having an equilateral square shape, so that it is deeply inserted into the tapped hole 18 to press the beater rod 11 towards the wall of the rod insertion hole 16, thus fixing the beater rod 11 within the rod insertion hole 16. Herein, a tuning key (not shown) for use in tuning of the bass drum can be commonly used to tighten or loosen the bolt 20. Normally, the tuning key is used to adjust the tension applied to the drumhead of a bass drum by rotating bolts of the bass drum (not shown).

A fixing member receiving portion 21 is arranged on the upper surface 17*a* of the rod fixing portion 9B in order to establish a prescribed positioning of a fixing member 27 being engaged with the beater rod 11 and to avoid rotation of the fixing member 27. The fixing member receiving portion 21 is projected from the back end portion of the upper surface 17*a* of the rod fixing portion 9B and is formed roughly in a concave shape in plan view, wherein it has a trapezoidal concavity 22 (see FIG. 2) projecting upwards in height and is elongated along the overall width of the upper surface 17*a* of the rod fixing portion 9B. Herein, the trapezoidal concavity 22 has interior walls 22*a* that have tapered surfaces (or slanted slopes), which are slanted inwardly.

The fixing member 27 is constituted by a block roughly having a trapezoidal shape in plan view, which has an appropriate thickness. Herein, the fixing member 27 has a through hole 28, which is formed at a prescribed center position in the back end portion thereof and into which the beater rod 11 is inserted. In addition, the fixing member 27 has a tapped hole 29 that is formed perpendicular to the through hole 28. Specifically, the through hole 28 is formed to penetrate through the fixing member 28 in the thickness direction between upper and lower surfaces 27*a* and 27*b*. In addition, the tapped hole 29 is formed approximately at the center position of a surface 27*c* of the fixing member 27 in the width direction and is communicated with the through hole 28, so that a bolt 30 is screwed into the tapped hole 29 so as to fix the fixing member 27 to a prescribed position of the beater rod 11. Similar to the aforementioned bolt 20, the bolt 30 has a head of an equilateral square shape. In conformity with the aforementioned trapezoidal concavity 22, the back end portion of the fixing member 27 has a trapezoidal shape in plan view so as to form an engagement portion 31 that substantially matches the trapezoidal concavity 22. Herein, the engagement portion 31 of the fixing member 27 has a pair of tapered surfaces (or slopes) 31*a*, which are forced to be brought into contact with the slopes 22*a* of the trapezoidal concavity 22 when the fixing member 27 is engaged with the rod fixing portion 9B of the rocker 9.

In FIG. 1, the foot board 12 is made of an approximately flat board whose size sufficiently meets the standard size of a user's foot, wherein the back end portion thereof is interconnected with the heel 3 in a free rotation manner via a pin (not shown). In addition, a restoration spring 35 is arranged along the length direction of the support member 2B to normally restore the front end portion of the foot board 12 upwards. The upper end of the restoration spring 35 is interconnected with a cam plate 36 that is attached to one end of the rotation shaft 6, and the lower end is interconnected with a spring bearing member 37 arranged on the lower end of the support member 2B. As the depression transmission member 13, it is possible to use a leather band or a resin band having flexibility or elasticity. Instead, it is possible to use a timing belt, chain, or the like.

In assembly of the foot pedal 1, the beater rod 11 is fixed to the rocker 9 in accordance with the following procedures.

(a) Firstly, the beater rod 11 is inserted into the through hole 28 of the fixing member 27; then, the bolt 30 is screwed into the tapped hole 29 of the fixing member 27 so as to press the beater rod 11 to the interior wall of the through hole 28 in the backward direction. Thus, it is possible to firmly attach the fixing member 27 to a prescribed position of the beater rod 11. In this case, the fixing member 27 is adjusted in the axial position thereof in such a way that the direction thereof substantially matches a prescribed beating direction of the beater 10. That is, the fixing member 27 is fixed to the beater rod 11 in such a way that a center line 33 of the fixing member 27 in the length direction substantially matches a prescribed line, which connects between a beating portion 32 of the beater 10 for actually beating the drumhead and a center 'O' (see FIG. 3) of the beater 10.

(b) Next, the base portion of the beater 11 is inserted into the rod insertion hole 16 of the rocker 9, so that the engagement portion 31 of the fixing member 27 is descended down to engage with the trapezoidal concavity 22 of the fixing member receiving portion 21 of the rod fixing portion 9B of the rocker 9. Thus, the fixing member 27 is mounted on the upper surface 17*a* of the rod fixing portion 9B. When the engagement portion 31 of the fixing member 27 is completely engaged with the trapezoidal concavity 22 of the fixing member receiving portion 21, it is possible to avoid unwanted rotation of the fixing member 27, in other words, it is possible to avoid axial rotation of the beater rod 11.

(c) FIG. 3 shows that the engagement portion 31 of the fixing member 27 is completely engaged with the trapezoidal concavity 22 of the fixing member receiving portion 21, wherein in order to facilitate engagement therebetween, an appropriate gap d is provided between the concave wall of the trapezoidal concavity 22 and the center wall of the engagement portion 31. In addition, an appropriate gap is provided between the exterior wall of the beater rod 11 and the interior wall of the rod insertion hole 16. The aforementioned gap d can be eliminated by moving the fixing member 27 backwards, thus bringing the engagement portion 31 into close contact with the trapezoidal concavity 22. In this state, however, the beater rod 11 is not completely brought into close contact with the interior wall of the rod insertion hole 16, so that some gap may still exist like a ring space around the beater rod 11 in the rod insertion hole 16. The axial line of the rod insertion hole 16 does not necessarily match the axial line of the through hole 28 of the fixing member 27. Specifically, the axial line of the through hole 28 may be shifted forwards compared with the axial line of the rod insertion hole 16. In other words, the rod insertion hole 16 is slightly shifted in a backward direction for tightly screwing the bolt 20 in comparison with the through hole 28. This is illustrated in FIG. 3 in which the rod insertion hole 16 is slightly shifted by "Δ" in the backward direction for tightly screwing the bolt 20.

(d) When the bolt 20 is deeply screwed into the tapped hole 18 of the rod fixing portion B so as to press the counterpart of the beater rod 11 in the rod insertion hole 16, the beater rod 11 is partially bent backwards (i.e., leftwards in FIG. 3) so that the engagement portion 31 of the fixing member 27 is correspondingly moved backwards and is therefore completely engaged with the trapezoidal concavity 22 of the fixing member receiving portion 21. In this case, the aforementioned gap d is reduced but is not completely eliminated, wherein the slopes 31*a* of the engagement portion 31 are both pressed by the slopes 22*a* of the fixing member receiving portion 21. Thus, the fixing member 27 is firmly fixed in position by the fixing member receiving portion 21 of the rod fixing portion 9B of the rocker 9, thus avoiding unwanted rotation of the fixing member 27 tightly holding the beater rod 11. In this state, the rod insertion hole 16 is shifted by "Δ" in the backward direction for tightly screwing the bolt 20 in comparison with the through hole 28 of the fixing member 27. As a result, the beater rod 11 is firmly fixed to the rocker 9 in such a way that the lower end portion of the beater rod 11 is pressed to the interior wall of the rod insertion hole 16 in proximity to its lower opening.

When the beater rod 11 is fixed to the rocker 9 as described above, the beater rod 11 is automatically supported by three contact points P1, P2, and P3, wherein the beater rod 11 is pressed by the bolt 20 and is brought into contact with the tip end of the bolt 20 at the contact point P1 in the rod insertion hole 16; the beater rod 11 is brought into contact with the edge of the lower opening of the through hole 28 of the fixing member 27 at the contact point P2, whereby the slopes 22*a* of the fixing member receiving portion 21 come in contact with the slopes 31*a* of the engagement portion 31 of the fixing member 27; and the beater rod 11 is brought into contact with the edge of the lower opening of the rod insertion hole 16 at the contact point P3. Due to automatic establishment of such three-point supports, it is possible to improve a capability of tightly holding the beater rod 11 with the rocker 9.

In the initial state of the foot pedal 1 shown in FIG. 1, the front end of the foot board 12 is held at a prescribed elevation from the floor surface and the like. When the user (or operator) depresses the foot pedal 12 with his/her foot, the depression transmission member 13 is correspondingly lowered to rotate the rotation shaft 6 in the clockwise direction in FIG. 1. Therefore, the beater rod 11 is correspondingly rotated together with the rotation shaft 6, so that the beater 10 is rotatably moved to beat the drumhead of a bass drum (not shown). Herein, a maximal depression angle applied to the foot pedal 12 is approximately set to 15°, for example. After beating the drumhead, the user releases his/her depression on the foot board 12, so that the front end of the foot board 12 is automatically lifted upwards due to spring force of the restoration spring 35. Thus, the foot board 12 is restored to its original position as shown in FIG. 1 and is prepared for the next depression.

As described above, the foot pedal 1 of the present embodiment is designed in such a way that the fixing member 27 attached to the beater rod 11 is pressed to the fixing member receiving portion 21 of the rocker 9 and is firmly fixed in position. This guarantees secure fixation of the beater rod 11 joined with the rocker 9, and it is therefore possible to reliably avoid unwanted axial rotation of the beater rod 11 during the play of the bass drum with the foot pedal 1. That is, there may be substantially no possibility that the beating portion 32 of the beater 10 would be improperly adjusted in position or shifted from the desired position. In particular, the trapezoidal concavity 22 of the fixing member receiving portion 21 has a prescribed tapered shape, while the engagement portion 31 of the fixing member 27 correspondingly has a prescribed tapered shape. Thus, it is possible to accurately fix together the rocker 9 and beater 10 with a high directivity towards the drumhead of a bass drum and the like.

Moreover, the foot pedal 1 has a good assembling ability because the engagement portion 31 of the fixing member 27 is engaged with the trapezoidal concavity 22 of the fixing member receiving portion 21, and the beater rod 11 is inserted into the rod insertion hole 16 and is fixed by the bolt 20, thus reliably securing fixation of the beater rod 11 joined with the rocker 9. Therefore, the user (or operator) is not required to visually confirm whether or not the beater 10 has a proper directivity every time the user combines prescribed parts of the foot pedal 1. That is, it is very easy for the user (or operator) to install the beater rod 11 in the rocker 9 of the foot pedal 1.

Incidentally, it is possible to modify the foot pedal 1 of the present embodiment by using a reverse structure as to a prescribed positional relationship between the bolt 20 and the fixing member receiving portion 21 of the rocker 9 (see FIG. 1). That is, the present embodiment shows that the bolt 20 is arranged in the front side (or right side) of the rocker 9 while the fixing member 27 is received by the fixing member receiving portion 21 in the back side (or left side) of the rocker 9. Instead, the bolt 20 can be arranged in the back side (or left side) of the rocker 9 while the fixing member 27 is received by the fixing member receiving portion 21 in the front side (or right side) of the rocker 9. In such a reverse structure, the operator may easily operate the bolt 20 that is arranged opposite to the drumhead of a bass drum and the like.

Figure 5A:
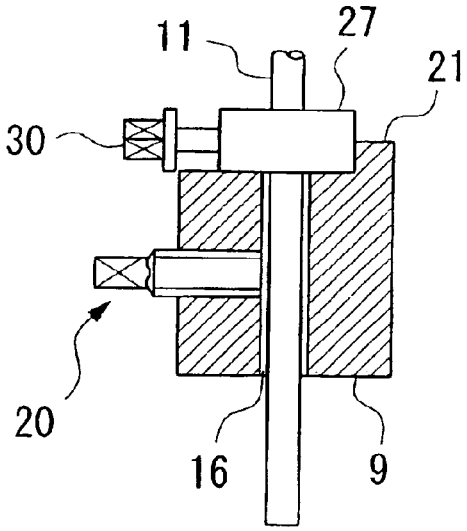
FIG. 5A is a cross sectional view showing another structure for fixing the beater rod to the rocker in the foot pedal.
Figure 5B:
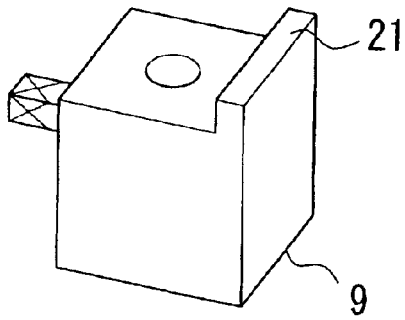
FIG. 5B is a perspective view showing the rocker having a fixing member receiving portion projected therefrom.

In addition, the fixing member receiving portion 21 of the rocker 9 is not necessarily formed in a trapezoidal shape; that is, it is possible to form the fixing member receiving portion 21 as a simple projection that projects upwardly from the upper surface of the rocker 9, wherein the fixing member 27 is correspondingly formed to match the fixing member receiving portion 21 (see FIGS. 5A and 5B).

Furthermore, the fixing member receiving portion 21 of the rocker 9 is required to be brought into close contact with the fixing member 27 when the bolt 20 is tightly screwed into the through hole 18 of the rocker 9 to press the beater rod 11 in the rod insertion hole 16. Therefore, the fixing member receiving portion 21 is not necessarily limited in shape and structure; hence, it is possible to employ various shapes and structures (e.g., circular arc shapes, etc.), which may allow the fixing member receiving portion 21 to properly engage with the fixing member 27.

As described heretofore, this invention has a variety of effects and technical features, which will be described below.

(1) A foot pedal of this invention is designed to establish fixation of a beater rod with a rocker in such a way that a fixing member attached to the beater rod is fixed to the rocker via a fixing member receiving portion. Therefore, it is possible to reliably avoid unwanted axial rotation of the beater rod, and it is possible to provide a beater of the beater rod with a high directivity against the drumhead of a bass drum and the like.

(2) Conventionally, the operator is required to visually confirm whether or not the beating portion of the beater is improperly adjusted in position or shifted from the desired position. In contrast, the foot pedal of this invention does not require the operator to perform such troublesome visual confirmation, and it is therefore possible for the operator to normally and fixedly use the same beating portion of the beater in beating the drumhead of a bass drum. Thus, the operator can perform the bass drum in a stable manner.

(3) When the beater rod is inserted into a rod insertion hole of the rocker, the engagement portion of the fixing member attached to the beater rod is pressed to, and completely brought into contact with, the trapezoidal concavity of the fixing member receiving portion of the rocker, so that the fixing member can be firmly fixed in position with the fixing member receiving portion of the rocker. In addition, the beater rod is strongly held and fixed in position within the rod insertion hole of the rocker, so that the beater rod can be tightly held together with the rocker in a stable manner.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A foot pedal for a drum, comprising:

a pedal frame having a pair of support members, which are planted vertically with a prescribed space therebetween;

a rotation shaft that is bridged between the pair of support members of the pedal frame and is supported to rotate freely;

a beater rod having a beater or a tip end thereof;

a fixing member having a through hole into which the beater rod is inserted and is fixed in position by a first fastening member;

a rocker fixed to the rotation shaft bridged between the pair of support members of the pedal frame, wherein the rocker has a rod insertion hole into which the beater rod is inserted and is fixed in position by a second fastening member, which is arranged to press the beater rod to an interior wall of the rod insertion hole, and wherein the rocker has a fixing member receiving portion for receiving the fixing member when engaged together; and a foot board, one end of which is interconnected with the pedal frame and the other end of which is interconnected with the rocker via a depression transmission member.

2. A foot pedal for a drum, comprising:

a pedal frame having a pair of support members, which are planted vertically with a prescribed space therebetween;

a rotation shaft that is bridged between the pair of support members of the pedal frame and is supported to rotate freely;

a beater rod having a beater at a tip end thereof;

a fixing member having a through hole into which the beater rod is inserted and is fixed in position by a first fastening member;

a rocker fixed to the rotation shaft bridged between the pair of support members of the pedal frame, wherein the rocker has a rod insertion hole into which the beater rod is inserted, and a secondary hole which is substantially perpendicular to the rod insertion hole and into which a second fastening member is inserted to press the beater rod to an interior wall of the rod insertion hole, and wherein the rocker has a fixing member receiving portion that projects upwards from an upper surface of the rocker to receive the fixing member when engaged together; and a foot board, one end of which is interconnected with the pedal frame, and the other end of which is interconnected with the rocker via a depression transmission member.

3. The foot pedal for a drum according to claim 2, wherein the fixing member has an engagement portion having tapered slopes, which match tapered slopes of a trapezoidal concavity formed on the fixing member receiving portion of the rocker when engaged together.

4. The foot pedal for a drum according to claim 2, wherein the rod insertion hole of the rocker is slightly shifted in position in a direction for tightly fastening the beater rod therein using the second fastening member from the through hole of the fixing member.

5. The foot pedal for a drum according to claim 2, wherein both the first and second fastening members are bolts, which can be manually operated.

6. The foot pedal for a drum according to claim 2, wherein the fixing member receiving portion is arranged substantially opposite to an arrangement of the second fastening member, so that when the beater rod is pressed to the interior wall of the rod insertion hole, the fixing member is automatically engaged with the fixing member receiving portion of the rocker.

7. The foot pedal for a drum according to claim 1, wherein the fixing member has an engagement portion having tapered slopes, which match tapered slopes of a trapezoidal concavity formed on the fixing member receiving portion of the rocker when engaged together.

8. The foot pedal for a drum according to claim 1, wherein the rod insertion hole of the rocker is slightly shifted in position in a direction for tightly fastening the beater rod therein using the second fastening member from the through hole of the fixing member.

9. The foot pedal for a drum according to claim 1, wherein both The first and second fastening members are bolts, which can be manually operated.

10. The foot pedal for a drum according to claim 1, wherein the fixing member receiving portion is arranged substantially opposite to an arrangement of the second fastening member, so that when the beater rod is pressed to the interior wall of the rod insertion hole, the fixing member is automatically engaged with the fixing member receiving portion of the rocker.

* * * * *